US008887536B2

(12) United States Patent
Kim et al.

(10) Patent No.: US 8,887,536 B2
(45) Date of Patent: Nov. 18, 2014

(54) ODOR SUPPLY APPARATUS AND WASHING/DRYING MACHINE HAVING THE SAME

(75) Inventors: Kyeong-Hwan Kim, Seoul (KR); Jin-Ho Chang, Seoul (KR); Kyung-Chul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 224 days.

(21) Appl. No.: 12/935,776

(22) PCT Filed: Sep. 8, 2008

(86) PCT No.: PCT/KR2008/005282

§ 371 (c)(1),
(2), (4) Date: Sep. 30, 2010

(87) PCT Pub. No.: WO2010/027115

PCT Pub. Date: Mar. 11, 2011

(65) Prior Publication Data

US 2011/0138863 A1 Jun. 16, 2011

(51) Int. Cl.

| | |
|---|---|
| ***D06F 29/00*** | (2006.01) |
| ***D06F 35/00*** | (2006.01) |
| ***D06F 58/20*** | (2006.01) |

(52) U.S. Cl.

CPC ..... *D06F 58/203* (2013.01)
USPC ..... 68/17 R

(58) Field of Classification Search

CPC ..... D06F 39/02
USPC ..... 68/17 R
See application file for complete search history.

(56) References Cited

U.S. PATENT DOCUMENTS

| | | | | |
|---|---|---|---|---|
| 5,367,716 | A * | 11/1994 | Huang | 4/222 |
| 2007/0205231 | A1 * | 9/2007 | Haul | 222/544 |

FOREIGN PATENT DOCUMENTS

| | | | |
|---|---|---|---|
| JP | 52-056472 | U | 4/1977 |
| JP | 58-050992 | A | 3/1983 |
| JP | 2000-300891 | A | 10/2000 |
| KR | 20-1990-0000057 | Y1 | 1/1990 |
| KR | 10-2003-0004716 | | 1/2003 |
| KR | 10-2005-0042932 | A | 5/2005 |
| KR | 10-2006-0105325 | A1 | 10/2006 |
| KR | 10-2007-0037127 | A1 | 4/2007 |
| KR | 10-2008-0053848 | | 6/2008 |
| KR | 10-2008-0053848 | A1 | 6/2008 |
| KR | 10-2003-0004716 | A1 | 1/2010 |

OTHER PUBLICATIONS

Kim et al., KR10-2008-0053848, Jun. 2008, English machine translation.*

* cited by examiner

*Primary Examiner* — Jason Ko
(74) *Attorney, Agent, or Firm* — McKenna Long & Aldridge LLP

(57) ABSTRACT

Disclosed are a fragrance supply apparatus and a washing/drying machine having the same, wherein the washing/drying machine comprises a fragrance supply apparatus installed in a washing/drying machine body for collecting clothes to be treated such that a fragrance solution contained therein is uniformly effused by a pressure difference to be supplied into the clothes within the washing/drying machine body, whereby the fragrance solution can be supplied at a desired time so as to prevent an unnecessary consumption thereof, and also prevent an occurrence of a deviation of an effused amount due to an amount of the fragrance solution contained in the fragrance supply apparatus.

18 Claims, 11 Drawing Sheets

ODOR SUPPLY APPARATUS AND WASHING/DRYING MACHINE HAVING THE SAME

This application is a 35 U.S.C. §371 National Stage entry of International Application No. PCT/KR2008/005282, filed on Sep. 8, 2008, which is hereby incorporated by reference in its entirety.

TECHNICAL FIELD

The present invention relates to a fragrance supply apparatus and a washing/drying machine having the same, and more particularly, a fragrance supply apparatus capable of preventing an occurrence of a deviation of an effused amount of a fragrance solution due to a contained amount thereof, and a washing/drying machine having the same.

BACKGROUND ART

A washing/drying machine includes a washer for washing laundry, a washer/dryer having a function of drying laundry after washing and dehydrating the laundry first, and a dryer for drying a washed and dehydrated laundry.

Korean Utility Model Registration No. 20-0165264 discloses "fragrance diffusing structure for washing machine" configured such that a fragrance diffusing apparatus for diffusing fragrance is disposed in a washing/drying machine to allow a user to directly smell such fragrance when the user opens a door of the washing machine after a washing operation or to allow a fragrance to be permeated into clothes, thus to make the user feel refreshed.

However, the fragrance diffusing structure for the washing machine is configured such that a holder provided with an accommodating space, an inlet and an air hole is integrally formed with a lower surface of a door, and a membrane fragrance is contained inside the accommodating space of the holder so as for the fragrance to be spontaneously diffused. Accordingly, even when the washing machine is not used, the fragrance is consumed and additionally such fragrance cannot properly be permeated into clothes with being simply diffused in the air.

Furthermore, as another example of a fragrance diffusing apparatus, Korean Patent Registration No. 10-0377411 discloses "washing machine having aromatic diffusing apparatus" in which a holder installed at a certain position of the washing machine for supporting an aromatic and a heating unit disposed near the aromatic supported by the holder, so as to enable the control of an aroma diffusion speed.

However, the washing machine with the aromatic diffusing apparatus is configured such that the holder supporting the aromatic is disposed between a top cover and a cabinet. Accordingly, fragrance diffused from the aromatic is diffused into a space between the top cover and the cabinet. However, the aromatic and clothes are partitioned by a tub and a rotating tub (inner tub), and thereby the diffused fragrance is not easily permeated into clothes.

DISCLOSURE

Technical Solution

To solve the drawbacks of the related art, one object of the present invention is to provide a fragrance supply apparatus capable of preventing an unnecessary consumption of a fragrance solution in a manner of supplying the fragrance solution at a desired time, and a washing/drying machine having the same.

Another object of the present invention is to provide a fragrance supply apparatus capable of preventing the occurrence of deviation of an effused amount of the fragrance solution depending on the amount of fragrance solution contained inside, and a washing/drying machine having the same.

To achieve the above object of the present invention, there is provided with a washing/drying machine having a fragrance supply apparatus including: a washing/drying machine body configured to collect clothes to be treated; and a fragrance supply apparatus configured such that a fragrance solution contained therein is uniformly effused by a pressure difference to be supplied into the clothes within the washing/drying machine body.

The fragrance supply apparatus may include: a fragrance solution container configured to contain the fragrance solution therein; a fragrance solution outlet to which the fragrance solution container is connected and through which the fragrance solution is effused; a dock having an air inlet formed at an upper side of the fragrance solution outlet; and an opening and closing unit configured to open and close the air inlet.

The opening and closing unit may include a solenoid for opening the air inlet when power is applied.

The washing/drying machine body may include a tub in which the clothes are collected, an effusion side of the fragrance supply apparatus being connected the tub.

The washing/drying machine body may further include: a mode selector configured to select an operation mode including a fragrance supply mode for supplying fragrance into the clothes; and a controller configured to control the solenoid such that the fragrance is supplied when the fragrance supply mode is selected by the mode selector.

The fragrance supply mode may be configured to supply fragrance when performing at least one of the last rinsing and the last dehydrating during a washing process for the clothes.

The washing/drying machine body may include: a tub configured to collect the clothes therein; and a vapor generator configured to supply vapor to the tub, wherein the fragrance supply apparatus is connected to a vapor discharge pipe of the vapor generator.

The washing/drying machine body may further include: a mode selector configured to select an operation mode including a fragrance supply mode for supplying fragrance into the clothes; and a controller configured to control the solenoid such that the fragrance is supplied when the fragrance supply mode is selected by the mode selector.

The fragrance supply mode may be configured to supply fragrance when performing at least one of the last rinsing and the last dehydrating during the washing process for the clothes.

The operation mode may further include a refresh mode in which clothes are washed by supplying vapor without supplying washing water, and in the refresh mode, the fragrance supply mode may be configured to supply fragrance after the vapor supply is terminated.

The washing/drying machine body may include: a tub configured to collect the clothes therein; and a circulation duct through which air in the tub is blown out and circulated, wherein the fragrance supply apparatus is connected to the circulation duct.

The washing/drying machine body may further include: a mode selector configured to select an operation mode including a fragrance supply mode for supplying fragrance into the clothes; and a controller configured to control the solenoid such that the fragrance is supplied when the fragrance supply mode is selected by the mode selector.

The washing/drying machine body may further include: a fan configured to facilitate the circulation of air inside the circulation duct; and a heater configured to heat air in the circulation duct, wherein the fragrance supply mode is configured to supply fragrance when performing at least one of the last rinsing, the last dehydrating, and the drying of the clothes, during a washing process for the clothes.

The fragrance supply mode may be configured such that fragrance is supplied when the heater is turned off during a drying process for the clothes.

The operation mode may further include a refresh mode in which the clothes are washed by supplying hot air without supplying washing water, and in the refresh mode, the fragrance supply mode may be configured such that fragrance is supplied when the heater is turned off.

The fragrance solution container may be provided with a blocking member configured to block a lower opening thereof by its own weight.

The dock may be provided with an opening operation portion configured to come in contact with the blocking member thus to open the lower opening of the fragrance solution container.

The fragrance solution container may include: a container main body having a lower opening; a mount member coupled to the container main body; and a blocking member movably disposed between the container main body and the mount member and configured to block the lower opening of the mount member by its own weight.

The dock may be provided with an opening operation portion configured to come in contact with the blocking member to upwardly move the blocking member, thus to unblock the diffusion of the fragrance solution.

A fragrance solution flowing portion may be formed at an upper surface of the blocking member to allow the fragrance solution to downwardly flow in spite of being contacted with the periphery of the lower opening of the container main body.

A sealing member for blocking the effusion of the fragrance solution may be disposed at a contact surface between the blocking member and the mount member.

An operation hole, through which the fragrance solution container is attached or detached from the outside, may be formed at the washing/drying machine body.

In accordance with another aspect of the present invention, there is provided with a fragrance supply apparatus including: a fragrance solution container configured to contain the fragrance solution therein; a fragrance solution outlet to which the fragrance solution container is connected and through which the fragrance solution is effused; a dock having an air inlet formed at an upper side of the fragrance solution outlet; and a solenoid configured to open and close the air inlet.

Advantageous Effects

As described above, in the present invention, a fragrance solution outlet is disposed at a lower portion of the fragrance solution container so as for the fragrance solution to be effused therethrough, and an air inlet for generating a certain pressure difference is formed at an upper side of the fragrance solution outlet, such that the fragrance solution can be effused by the difference between a pressure applied to the fragrance solution outlet and a pressure applied to the air inlet when the air inlet is open, whereby the occurrence of a deviation of an effused amount of the fragrance solution depending on the amount of fragrance solution contained in the fragrance solution container can be prevented, and also the effused amount of the fragrance solution can accurately be controlled according to a time for which the air inlet is open.

Also, instead of opening and closing the fragrance solution outlet, the air inlet is open and closed by the solenoid, resulting in a remarkable reduction of a driving force or capacity of the solenoid.

The fragrance supply apparatus according to the present invention employs a configuration in which any separate structure for discharging air existing on a fragrance solution passage is not required at the time of its initial installation, and accordingly, after the installation, only opening the air inlet allows the fragrance solution to be immediately supplied.

In the present invention, the fragrance solution is supplied at a preset time for supplying the fragrance solution into clothes and the supplied fragrance solution is diffused via a connection pipe, into a position closer to the clothes, namely, at a door, in a gasket, in an outer tub, in a vapor discharge pipe, or in a circulation duct, whereby an unnecessary consumption of fragrance due to its diffusion into the air at an undesired time can be prevented.

Also, in the present invention, the fragrance solution is induced to be diffused in an air passage (circulation duct) or a vapor passage (vapor discharge pipe), so as to facilitate the diffusion of fragrance by a relatively high temperature, and additionally the clothes and fragrance can contact with each other more easily by immediately moving the diffused fragrance toward the clothes with preventing the spread of the diffused fragrance, resulting in improvement of the efficiency of the fragrance supply.

In addition, an operation hole through which the fragrance solution container can be attached or detached is disposed outside the washing/drying machine body, so as to facilitate the refilling of fragrance solution or the replacement of the fragrance solution container.

MODE FOR INVENTION

Hereinafter, the present invention will be described in detail with reference to the accompanying drawings.

Figure 1:
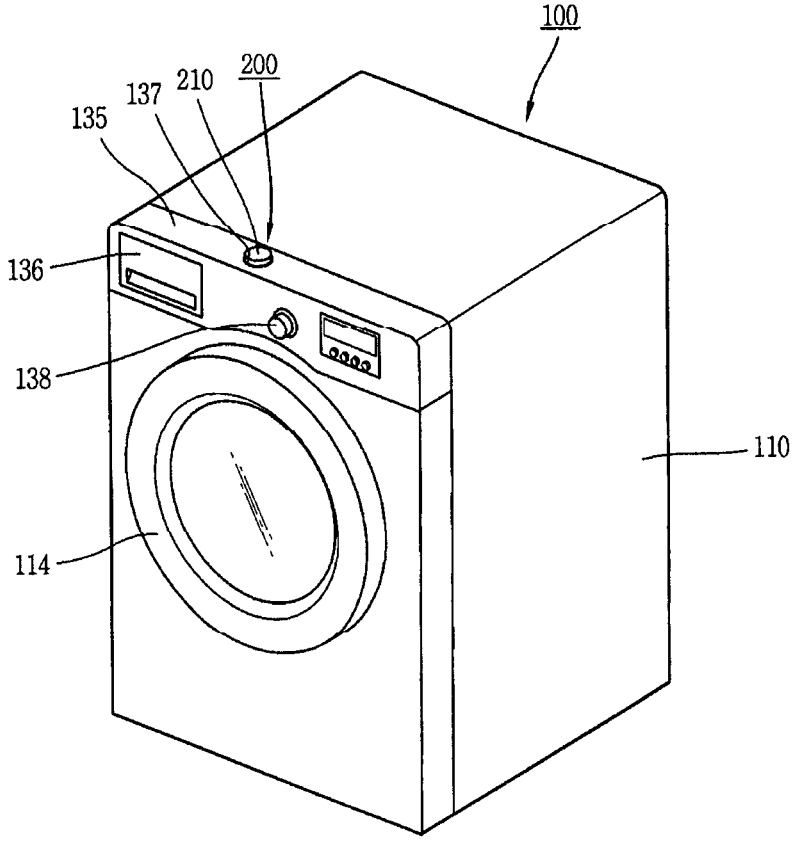
FIG. 1 is a perspective view showing a washing/drying machine having a fragrance supply apparatus in accordance with one embodiment of the present invention.
Figure 2:
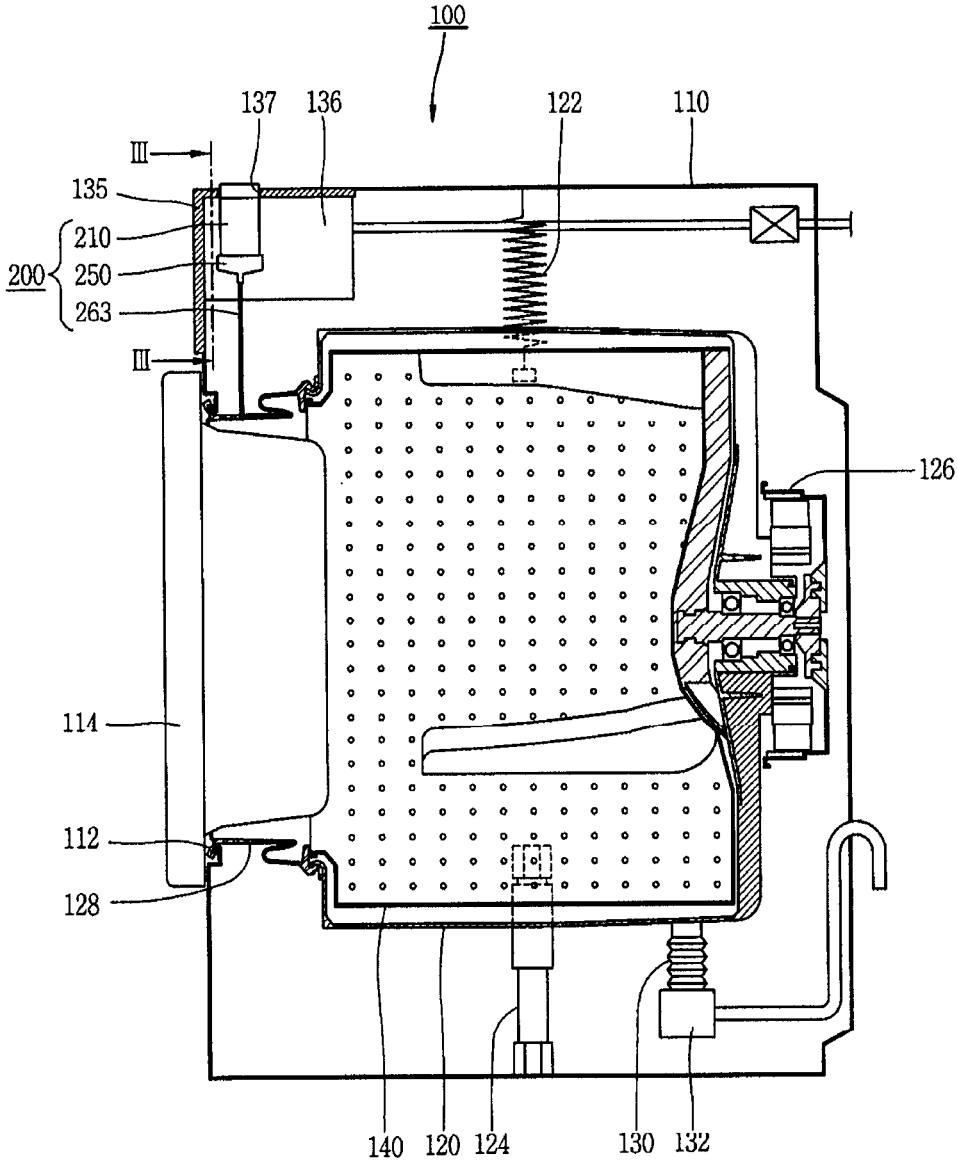
FIG. 2 is a lateral cross-sectional view of FIG. 1.

As shown in FIGS. 1 and 2, a washing/drying machine having a fragrance supply apparatus according to the present invention may include a washing/drying machine body 100 for collecting therein clothes to be treated, and a fragrance supply apparatus 200 configured such that a fragrance solution contained therein is uniformly effused by a pressure difference so as to be supplied into the clothes collected in the washing/drying machine body 100.

The washing/drying machine body 100 may be implemented as a washing machine including a cabinet 110, an outer tub 120 installed in the cabinet 110, and an inner tub 140 rotatably installed in the outer tub 120. An opening 112 is formed at a front surface of the cabinet 110, and a door 114 for opening and closing the opening 112 is installed at one side of the opening 112.

The outer tub 120, which is cylindrically formed and has one side open, is disposed in the cabinet 110. The outer tub 120 is supported by a plurality of springs 122 and dampers 124. A driving motor 126 for rotating the inner tub 140 is installed at a rear end portion of the outer tub 120. A gasket 128 for preventing water leakage is installed at a front region of the outer tub 120. The gasket 128 has one end connected to the opening 112 of the cabinet 110 and another end connected to a front side of the outer tub 120. A drain pipe 130 is connected to a lower portion of the outer tub 120, and a drain pump 132 for pumping water is disposed at the drain pipe 130.

A control panel 135 is installed at an upper region of a front surface of the cabinet 110. A detergent tray 136 is retracted in one side of the control panel 135 and an operation dial 138 for selecting an operation mode or the like is disposed at another side of the control panel 135. A fragrance supply apparatus 200 for supplying fragrance into clothes inside the inner tub 140 is installed at a rear side of the control panel 135.

Figure 3:
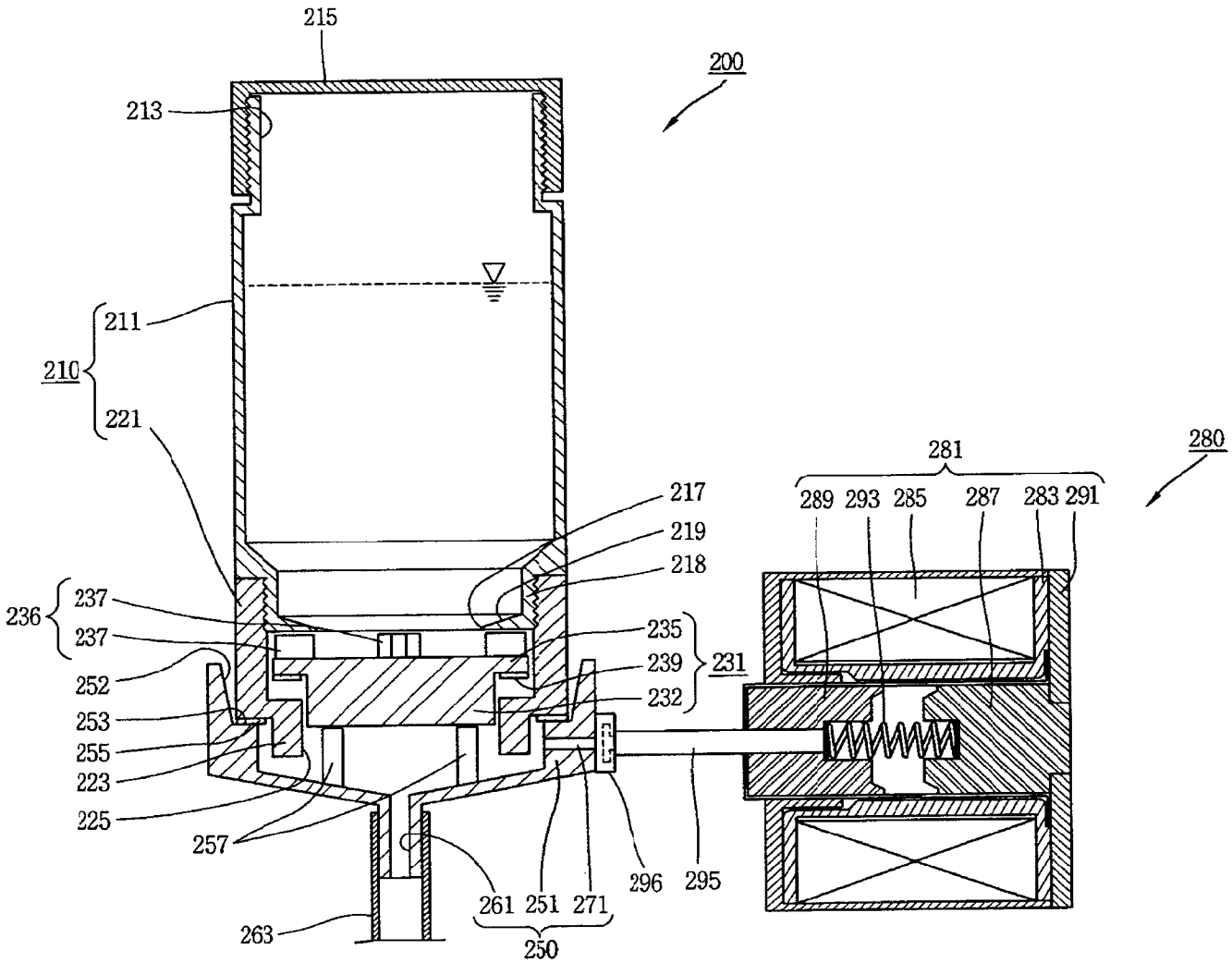
FIG. 3 is an enlarged view taken along the line III-III of FIG. 2.
Figure 4:
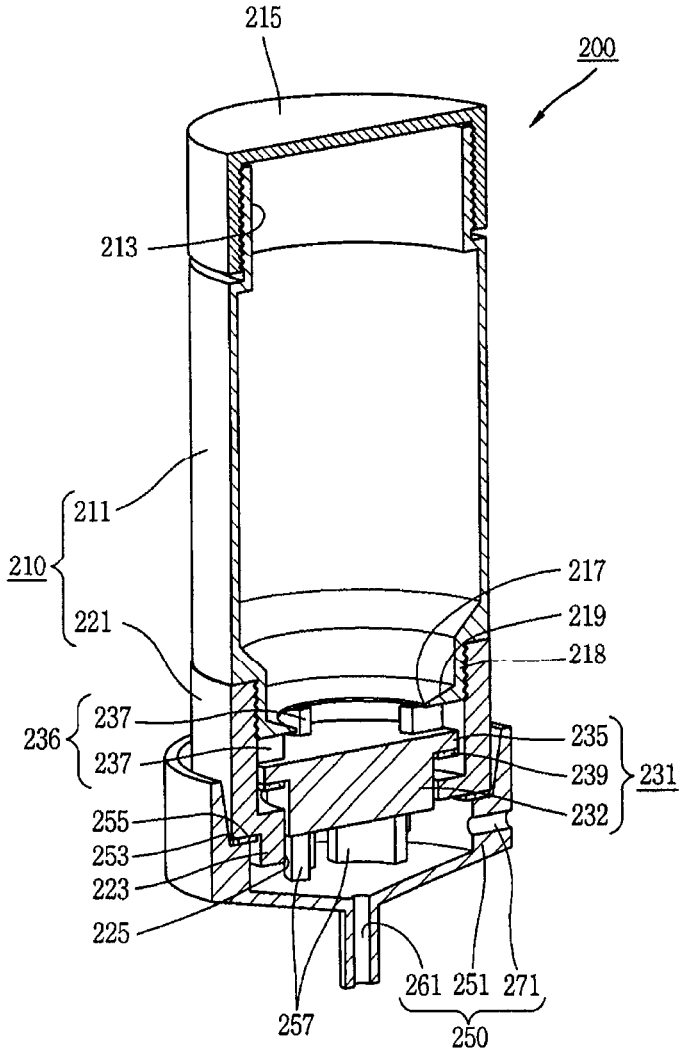
FIG. 4 is a perspective view showing a partially cut fragrance solution container of FIG. 3.

The fragrance supply apparatus 200, as shown in FIGS. 3 and 4, may include a fragrance solution container 210 for containing the fragrance solution therein, a fragrance solution outlet 261 to which the fragrance solution container 210 is connected and through which the fragrance solution flows out, a dock 250 having an air inlet 271 formed at an upper side of the fragrance outlet 261, and an opening and closing unit 280 for opening and closing the air inlet 271. Here, the fragrance solution container 210 may be detachable from the outside via an operation hole 137 formed through an upper end of the control panel 135.

The fragrance solution container 210 may include a container main body 211 for containing the fragrance solution, a mount member 221 coupled to one end portion of the container main body 211 to be communicated with each other, and a blocking member 231 for blocking an outlet of the mount member 221 by its own weight.

The container main body 211 is formed in a cylindrical shape. The container main body 211 is disposed in a direction of gravity being applied such that the fragrance solution can downwardly flow by the gravity. An injection hole 213 through which the fragrance solution is injected is formed at an upper end of the container main body 211. A cap 215 for tightly sealing the injection hole 213 is coupled to the injection hole 213. A coupling unit 218 cut down in a radial direction of the container main body 211 is formed at a lower end of the container main body 211. The mount member 221 is coupled to the coupling unit 218 to tightly seal the same. An opening 217 through which the fragrance solution flows out is formed at a lower end of the coupling unit 218. A guide inclination portion 219 is formed inside the coupling unit 218 to be inwardly inclined, which allows the fragrance solution to smoothly flow downwardly.

The mount member 221 is formed in a pail-like shape upwardly open. The mount member 221 is also formed to have almost the same diameter as that of the container main body 211. A dock coupling portion 223 possibly inserted in the dock 250 for coupling is formed at a lower region of the mount member 221. The dock coupling portion 223 is horizontally, namely, inwardly reduced by a certain length in a radial direction of the mount member 221, and then longitudinally, namely, downwardly extended by a certain length. A discharge hole 225, which is downwardly open to discharge the fragrance solution, is formed at a central portion of the dock coupling portion 223. The blocking member 231 which is movable in a longitudinal direction is coupled into the mount member 221. The blocking member 231 may be configured to block the discharge hole 225 by its own weight.

The blocking member 231 may include a body 232 having a reduced size as compared to the discharge hole 225 and disposed in the discharge hole 225 to be movable up and down, and a flange portion 235 formed at an upper end of the body 232 and having an extended size as compared to the discharge hole 225. The flange portion 235 is contacted by an inner side of a lower surface of the mount member 221 so as to block the effusion of the fragrance solution. A sealing member 239 may be disposed at a lower surface of the flange portion 235 such that the flange portion 235 comes in contact with the inner side of the lower surface of the mount member 221 so as to block the effusion of the fragrance solution. A fragrance flowing portion 236 is formed at an upper surface of the flange portion 235 such that the fragrance solution can downwardly flow even if the lower end of the container main body 211 comes in contact with the upper surface of the flange portion 235. The fragrance flowing portion 236 is provided with a plurality of protrusions 237 protruded from the upper surface of the flange portion 235 up to a certain height and spaced apart from one another in a circumferential direction. That is, the fragrance solution flows in a space between the protrusions 237.

The dock 250 may include a dock body 251 having a pail-like shape upwardly open and having an upper side coupled to the fragrance solution container 210, a fragrance solution outlet 261 formed at a lower portion of the dock body 251 to allow the fragrance solution effused out of the fragrance solution container 210 to downwardly flow, and an air inlet 271 formed above the fragrance solution outlet 261 with having a certain height difference therebetween. Here, the air inlet 271 may be formed at a position to generate a pressure difference as great as being able to smoothly effuse the fragrance solution via the fragrance solution outlet 261 upon being open, by considering the viscosity of the fragrance solution. A supporting portion 253, on which the dock coupling portion 223 of the mount member 221 is mounted to be thusly supported thereby, is formed in the dock body 251. A guiding portion 252 is formed at an upper portion of the dock body 251, to be downwardly inclined toward the inside, so as to guide the fragrance solution container 210 upon the coupling of the fragrance solution container 210. A sealing member 255 is disposed at the supporting portion 253 to prevent an external leakage of the fragrance solution upon the coupling of the fragrance solution container 210. A lower surface of the dock body 251 is formed to be downwardly inclined toward its inside. Accordingly, the fragrance solution can smoothly flow into the fragrance solution outlet 261 formed at the central portion of the dock body 251. An opening operation portion 257 for upwardly moving the blocking member 231 so as to open the discharge hole 225 is disposed at a lower surface inside the dock body 251. The opening operation portion 257 is upwardly protruded from the lower surface of the dock body 251. The fragrance solution outlet 261 is connected to one end of a connection pipe 263. Another end of the connection pipe 263 is disposed at the upper portion of the gasket 128 to be communicated with the inside of the gasket 128. Here, the connection pipe 263 may be configured to be connected to the outer tub 120.

The opening and closing unit 280 for opening and closing the air inlet 271 is disposed at one side of the dock 250. The opening and closing unit 280 includes a solenoid 281 provided with an operation rod 295 disposed to be close to and spaced apart from the air inlet 271 for opening and closing the air inlet 271. Here, a pad 296 made of rubber which can airtightly contact the periphery of the air inlet 271 of the dock 250 may be attached to an end of the operation rod 295.

As shown in FIG. 3, the solenoid 281 may include a bobbin 283 formed in a cylindrical shape, a coil 285 wound around the bobbin 283 for generating a magnetic force upon power being applied, a fixed core 287 disposed inside the bobbin 283, a movable core 289 disposed at one side of the fixed core 287, an operation rod 295 connected to the movable core 289, a frame 291 configuring a magnetic path, and a restoring spring 293 for restoring the movable core 289 to its original position. Here, the operation rod 295 is disposed at a position for blocking the air inlet 271 by the elastic force of the restoring spring 293.

Figure 5:
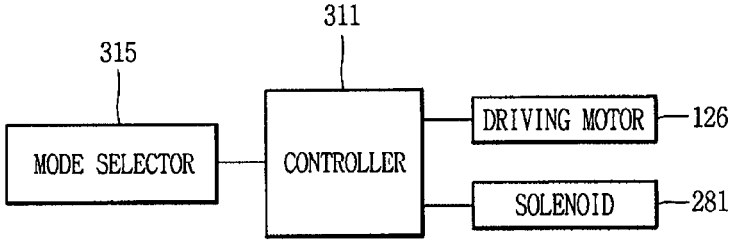
FIG. 5 is a control block diagram of the washing/drying machine shown in FIG. 1.

As shown in FIG. 5, the solenoid 281 may be configured to be connected to a controller 311 of the washing/drying machine body 100 such that a particular amount of fragrance solution can automatically be supplied, under the condition preset in a control program, upon power being applied. The control program may include a fragrance supply mode in which fragrance is supplied into clothes during a washing process. The fragrance supply mode may be configured such that fragrance can be supplied at the time of the last rinsing and/or the last dehydrating during a washing process. The controller 311 is connected to a mode selector 315 for selecting the fragrance supply mode. The mode selector 315 may be configured in a type of button or switch on the control panel 135. When the fragrance supply mode is selected by the mode selector 315, the controller 311 controls the solenoid 281 to open the air inlet 271. Accordingly, the fragrance solution is effused via the fragrance solution outlet 261 to be supplied into clothes.

Also, the fragrance solution can be supplied by a user's manual operation. A button 316 for a manual operation is disposed at the washing/drying machine body 100. Upon pressing the button 316, the controller 311 controls the solenoid 281 to supply the fragrance solution. That is, a user presses the button 316 under a state that the fragrance supply mode is unselected, so as to supply the fragrance solution. Also, after the selection of the fragrance supply mode, if it is desired to further supply fragrance, the button 316 is pressed again to further supply fragrance.

With such configuration, when the fragrance supply mode is selected by means of the mode selector 315, the controller 311 controls power to be applied to the solenoid 281 to open the air inlet 271. When power is applied to the solenoid 281, namely, to the coil 285, the operation rod 295 is moved to be spaced apart from the dock 250 so as to open the air inlet 271. After the air inlet 271 is open, a pressure difference is constantly generated due to a height difference between the fragrance solution outlet 261 and the air inlet 271. Accordingly, regardless of the change in the amount of fragrance solution contained in the fragrance solution container 210, the fragrance solution is dropped in proportion to an open time of the air inlet 271, so as to accurately control the supply amount of the fragrance solution. The dropped fragrance solution is introduced into the gasket 128 via the connection pipe 263 to thusly be diffused at a much closer position to clothes. Hence, an amount of fragrance solution diffused in the air without being contacted by clothes can be reduced and also an amount thereof permeated into the clothes can be increased.

On the other hand, when refilling the fragrance solution in the fragrance solution container 210, the fragrance solution container 210 is drawn out via the operation hole 137. When the fragrance solution container 210 is drawn out, the blocking member 231 is descended by its own weight so as to block the discharge hole 225 at the lower portion of the mount member 221. At this moment, the cap 215 is separated from the container main body 211 to refill the fragrance solution in the container main body 211. Afterwards, the cap 215 is coupled again, to block the opening on the container main body 211. The fragrance solution container 210 is then inserted via the operation hole 137 such that the mount member 221 is inserted in the dock 250. When the mount member 231 is inserted in the dock 250, the lower surface of the blocking member 231 comes in contact with the upper end of the opening operation portion 257 to be moved upwardly, thereby opening the discharge hole 225 at the lower portion of the mount member 221. Accordingly, the fragrance solution inside the fragrance solution container 210 flows downwardly to be filled in the dock 250. Here, since the dock 250 and the fragrance solution container 210 are changed into a vacuum state, the leakage of the fragrance solution via the fragrance solution outlet 261 can be prevented in the blocked state of the air inlet 271.

Hereinafter, another embodiment of the present invention will be described with reference to FIGS. 6 and 7.

Hereinafter, the aforementioned construction and the same or equivalent components will not be described again for the sake of brief explanation, and the same reference numerals will be given therefor.

Figure 6:
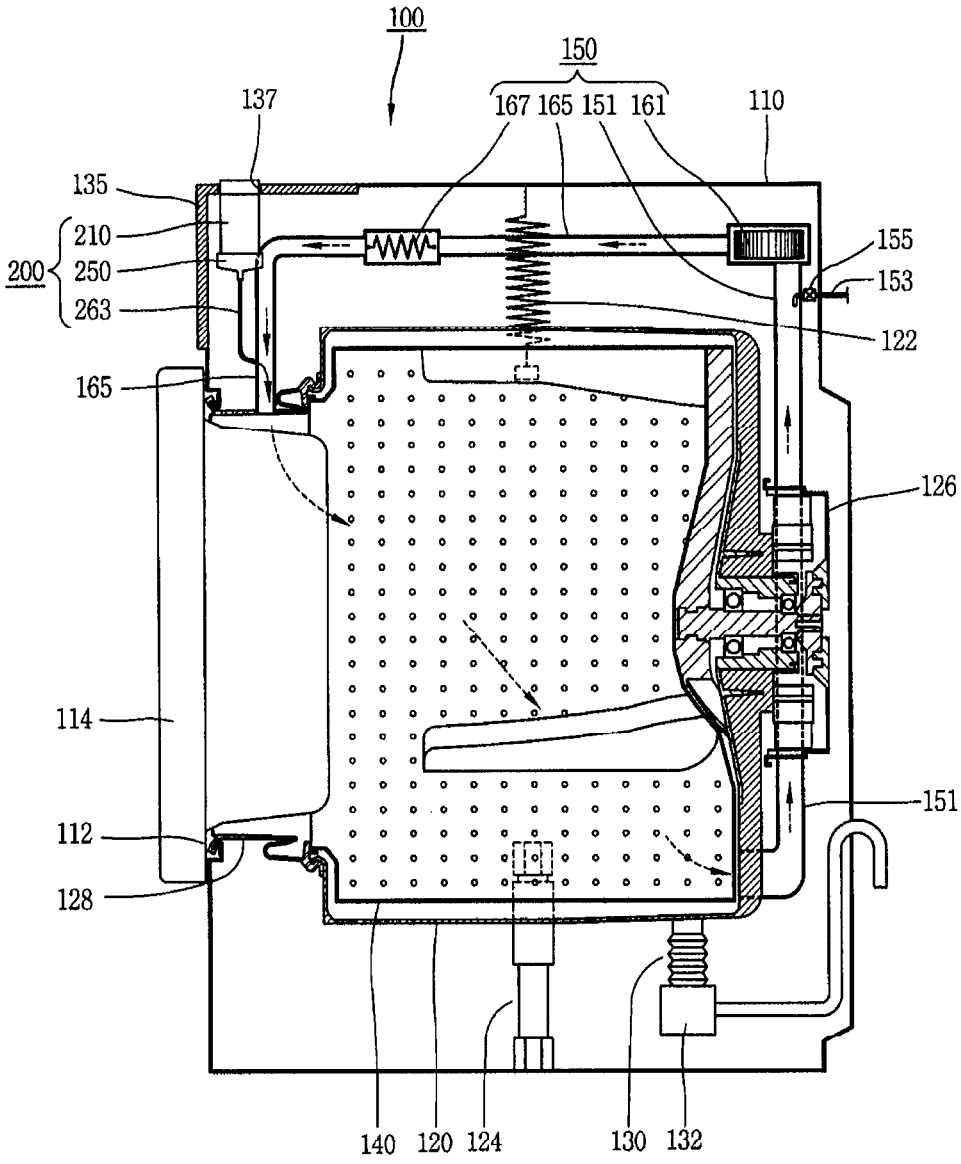
FIG. 6 is a cross-sectional view showing a washing/drying machine having a fragrance supply apparatus in accordance with another embodiment of the present invention.

As shown in FIG. 6, a washing/drying machine having a fragrance supply apparatus according to the present invention may include a washing/drying machine body 100 for collecting clothes to be treated, and a fragrance supply apparatus 200 configured such that a fragrance solution contained therein can be uniformly effused by a pressure difference to be supplied into the clothes collected in the washing/drying machine body 100.

The washing/drying machine body 100 is implemented as a type of washing and drying machine, including a cabinet 110, an outer tub 120 installed in the cabinet 110, an inner tub 140 rotatably installed in the outer tub 120, and a drying unit 150 for removing moisture by using air blown out of the outer tub 120, heating the air, supplying the heated air back into the outer tub 120 and thereby drying clothes. Opening 112 and door 114 through which the clothes are put into the inner tub 140 are configured at the front surface of the cabinet 110.

A driving motor 126 for rotating the inner tub 140 is installed at a rear end portion of the outer tub 120, and a drain pipe 130 having a drain pump 132 are connected to a lower region of the outer tub 120.

The drying unit 150 may include a condensation duct 151 longitudinally disposed at a rear region of the outer tub 120, a circulation duct 165 having one end connected to the condensation duct 151 and another side connected to a front side of the outer tub 120, a fan 161 for blowing air out via the condensation duct 151 for circulation, and a heater 167 for heating air inside the circulation duct 165. A water supply pipe 153 for supplying cooling water for condensing vapor is installed at the condensation duct 151, and a switching valve 155 is disposed at the water supply pipe 153.

In the meantime, the fragrance supply apparatus 200 for supplying fragrance into air introduced in the outer tub 120 is installed at a front region of the cabinet 110. As mentioned above, the fragrance supply apparatus 200 may include a fragrance solution container 210 for containing the fragrance solution therein, a fragrance solution outlet 261 to which the fragrance solution container 210 is connected and through which the fragrance solution is discharged, a dock 250 having an air inlet 271 formed at an upper side of the fragrance outlet 261, and an opening and closing unit 280 for opening and closing the air inlet 271.

The fragrance solution container 210 may include a container main body 211, a mount member 221 coupled to one end portion of the container main body 211 to be communicated with each other, and a blocking member 231 for blocking the outlet of the mount member 221 by its own weight.

The dock 250 may include a dock body 251 having a pail-like shape upwardly open and having an upper side coupled to the fragrance solution container 210, a fragrance solution outlet 261 formed at a lower portion of the dock body 251 to allow the fragrance solution effused out of the fragrance solution container 210 to downwardly flow therethrough, and an air inlet 271 formed above the fragrance solution outlet 261 with having a certain height difference therebetween. The opening and closing unit 280 implemented as a solenoid 281 with an operation rod 295 is disposed at the air inlet 271. One end of the connection pipe 263 is connected to the circulation duct 165, and another end thereof is connected to the fragrance solution outlet 261.

Figure 7:
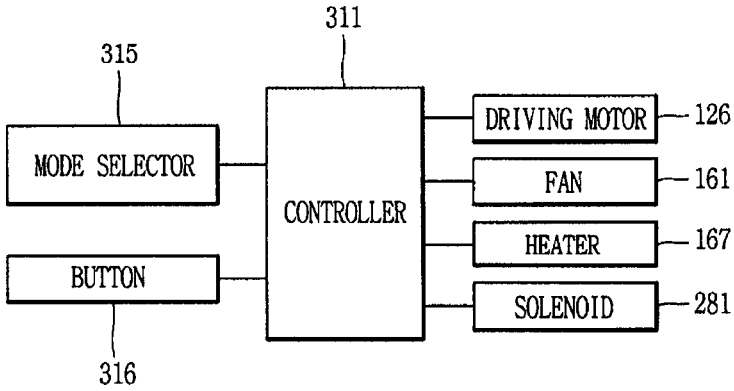
FIG. 7 is a control block diagram of the washing/drying machine shown in FIG. 6.

As shown in FIG. 7, the solenoid 281 is connected to a controller 311 having a control program. The control program may include plural operation modes including a fragrance solution mode for supplying fragrance into clothes. The operation modes may include a general washing mode for washing clothes by supplying water to the clothes, a drying mode for drying the washed clothes, and a refresh mode for removing wrinkles and/or odor from the clothes without supplying water to the clothes. The controller 311 is connected to a mode selector 316 for selecting each operation mode. Here, the fragrance supply mode may be selected simultaneously with any one of the washing mode, the drying mode and the refresh mode.

That is, when the washing mode and the fragrance supply mode are selected, the controller 311 may control the solenoid 281 to supply the fragrance solution at the time of the last rinsing and/or the last dehydrating during the washing process.

When the drying mode and the fragrance supply mode are selected, the controller 311 may control the solenoid 281 to supply the fragrance solution in a turn-off state of a heater 167, so as to prevent an insufficient fragrance deposition at a relatively high temperature and a deterioration of fragrance, which may occur due to the characteristic of the fragrance solution. Here, the controller 311 may control the solenoid to supply the fragrance solution in a state that the connection pipe 263 is connected to the inner tub 120 and the heater 167 is operated.

Also, when the refresh mode and the fragrance supply mode are selected, in order to prevent the fragrance solution from being supplied at a relatively high temperature, the controller 311 may control the solenoid 281 to supply the fragrance solution in a turn-off state of the heater 167.

With such configuration, when the drying mode and the fragrance supply mode are selected by the mode selector 315, the controller 311 controls the fan 161 and the heater 167 to be operated. Accordingly, the internal air of the outer tub 120 is blown out to flow upwardly along the condensation duct 151. Such air is cooled by water for condensation supplied via the water supply pipe 153, thereby removing moisture in the air. The air blown by the fan 161 is heated up by the heater 167, to be then introduced into the outer tub 120 via the circulation duct 165.

On the other hand, after a certain time elapses, when the heater 167 is turned off, the controller 311 controls such that power is applied to the solenoid 281, namely, the coil 285. When power is applied to the coil 285, then the movable core 289 moves in a direction that a magnetic resistance is decreased by a magnetic force generated by the coil 285, namely, toward the fixed core 287, thereby opening the air inlet 271. When the air inlet 271 is open, the fragrance solution is dropped by a difference between a pressure applied to the fragrance solution outlet 261 and a pressure applied to the air inlet 271. The dropped fragrance solution is then introduced into the circulation duct 165 via the connection pipe 263 to be diffused. The diffused fragrance is introduced into the inner tub 140 together with air flowing along the circulation duct 165. The introduced fragrance comes in contact with the clothes to be permeated into tissues of the clothes. When it is desired to further supply fragrance, the button 316 is operated (pressed) and accordingly the controller 311 controls the solenoid 281 to further supply the fragrance solution.

Hereinafter, another embodiment of the present invention will be described with reference to FIGS. 8 and 9.

Figure 8:
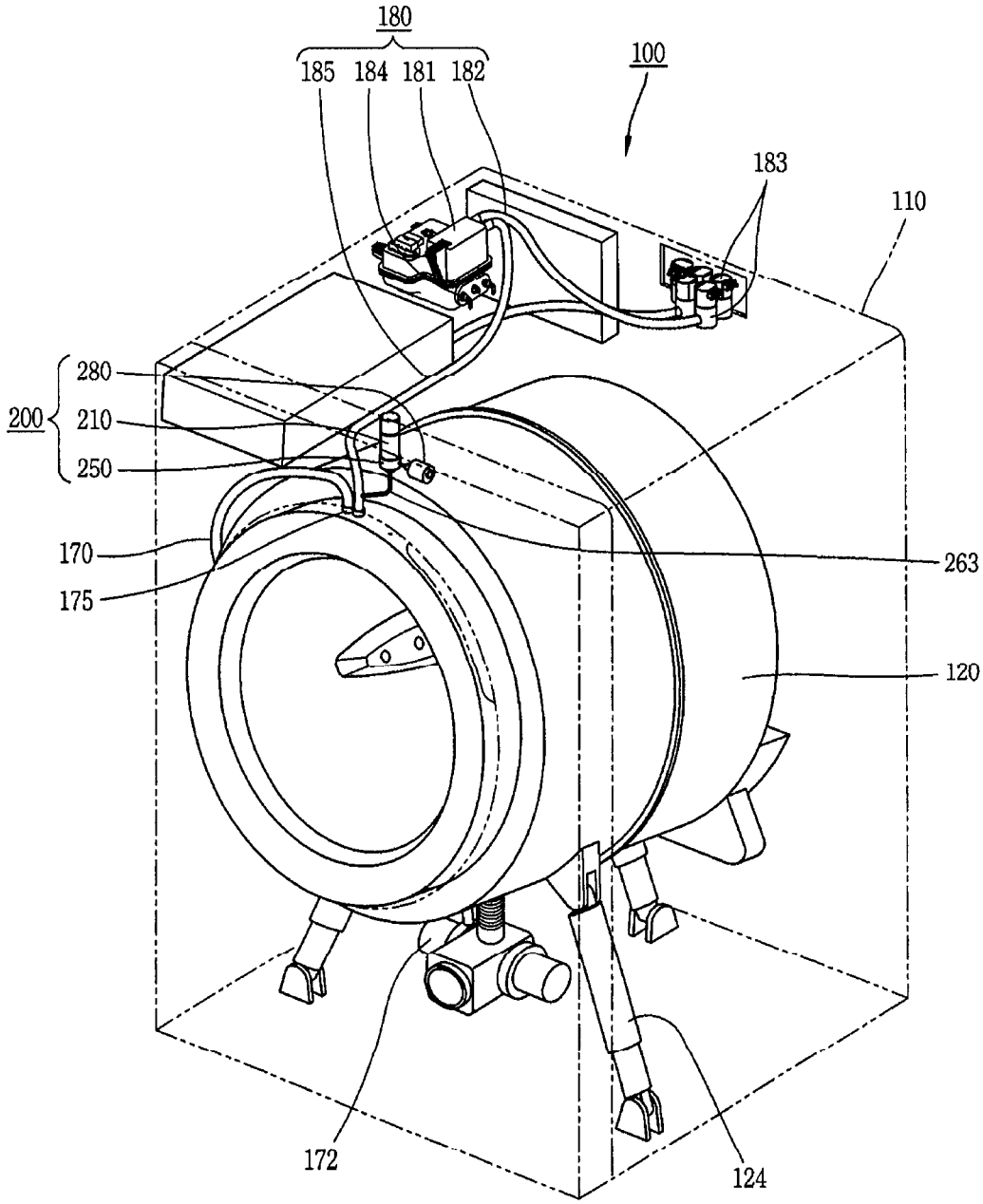
FIG. 8 is a perspective view showing an inside of a washing/drying machine having a fragrance supply apparatus in accordance with another embodiment of the present invention.

As shown in FIG. 8, a washing/drying machine having a fragrance supply apparatus according to the present invention may include a washing/drying machine body 100 for collecting clothes to be treated, and a fragrance supply apparatus 200 configured such that the fragrance solution contained therein is uniformly effused by a pressure difference so as to be supplied into the clothes collected in the washing/drying machine body 100.

The washing/drying machine body 100 may be implemented as a type of washing machine including a cabinet 110, an outer tub 120 installed in the cabinet 110, an inner tub 140 rotatably installed in the outer tub 120, and a vapor generator 180 for supplying vapor into the outer tub 120. Opening and door 114 through which the clothes are put into the inner tub 140 are disposed at the front surface of the cabinet 110.

A drain pipe 130 through which washing water is drained out of the outer tub 120 is connected to a lower region of the outer tub 120, and a washing water circulating passage 170, through which washing water in the outer tub flows out to be circulated, is formed at a front region of the outer tub 120. A circulation pump 172 for pumping and circulating washing water is provided at the washing water circulating passage 170.

A gasket 128 for connecting the front opening 112 of the cabinet 110 to the outer tub 120 is installed at the front region of the outer tub 120. An injector 175 for injecting washing water and vapor into the outer tub 120 is disposed at an upper region of the gasket 128.

The vapor generator 180 for generating vapor is installed above the outer tub 120. The vapor generator 180 may include a case 181 in which washing water and the generated vapor are temporarily stored, an electric heater 184 for heating the inside of the case 181 to generate vapor, a vapor discharge pipe 185 connected to one side of the case 181 for discharging the generated vapor therethrough, and a water supply pipe 182 for supplying water to become vapor into the case 181. A water supply valve 183 is installed at the water supply pipe 182. The vapor discharge pipe 185 extends to the front region of the outer tub 120 to be connected to the injector 175.

In the meantime, the fragrance supply apparatus 200 for supplying fragrance into vapor introduced into the outer tub 120 is installed at the front region of the cabinet 110. As aforementioned, the fragrance supply apparatus 200 may include a fragrance solution container 210 for containing the fragrance solution therein, a fragrance solution outlet 261 through which the fragrance solution is effused, a dock 250 having an air inlet 271 formed at an upper side of the fragrance outlet 261, and an opening and closing unit 280 for opening and closing the air inlet 271.

The fragrance solution container 210 may include a container main body 211, a mount member 221 coupled to one end portion of the container main body 211 to be communicated with each other, and a blocking member 231 for blocking an outlet of the mount member 221 by its own weight.

The dock 250 may include a dock body 251 having a pail-like shape upwardly open and having an upper side coupled to the fragrance solution container 210, a fragrance solution outlet 261 formed at a lower portion of the dock body 251 to allow the fragrance solution effused out of the fragrance solution container 210 to downwardly flow, and an air inlet 271 formed above the fragrance solution outlet 261 with having a certain height difference therebetween. The opening and closing unit 280 implemented as a solenoid 281 with an operation rod 295 is connected to the air inlet 271. One end of the connection pipe 263 is connected to the circulation duct 165, and another end thereof is connected to the fragrance solution outlet 261.

Figure 9:
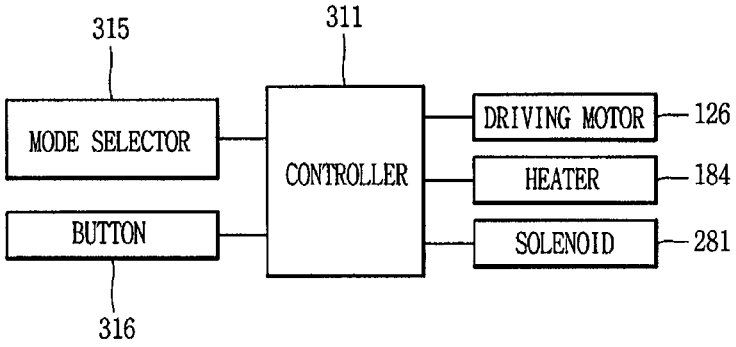
FIG. 9 is a control block diagram of the washing/drying machine shown in FIG. 8.

As shown in FIG. 9, the solenoid 281 is connected to a controller 311 having a control program. The control program may include plural operation modes including a fragrance solution mode for supplying fragrance into clothes. The operation modes may include a washing mode for washing clothes by supplying water and vapor to the clothes, and a refresh mode for removing wrinkles and/or odor from the clothes by supplying vapor to the clothes, not supplying water to the clothes. The controller 311 is connected to a mode selector 316 for selecting each operation mode. Here, the fragrance supply mode may be selected simultaneously with any one of the washing mode and the refresh mode.

That is, when the washing mode and the fragrance supply mode are selected, the controller 311 may control the solenoid 281 to supply the fragrance solution at the time of the last rinsing and/or the last dehydrating during the washing process. Here, the controller 311 may control the solenoid 281 to supply the fragrance solution at the time when the vapor is supplied.

Also, when the refresh mode and the fragrance supply mode are selected, the controller 311 may control the solenoid 281 to supply the fragrance solution when the vapor is supplied.

Also, in the washing mode or the refresh mode, the controller 311 may control the solenoid to supply the fragrance solution when the vapor supply is terminated. In this case, the connection pipe 263 may be connected to the outer tub 120 so as for the fragrance solution to be supplied into the outer tub 120.

With such configuration, upon desiring to supply fragrance into clothes, the vapor generator 180 generates vapor to supply into the inner tub 140. In this state, power is applied to the coil 285 of the solenoid 281 so as to open the air inlet 271. When the air inlet 271 is open, the fragrance solution is dropped via the fragrance solution outlet 261 by a difference between a pressure applied to the fragrance solution outlet 261 and a pressure applied to the air inlet 271. The dropped fragrance solution is then introduced into the vapor discharge pipe 185 via the connection pipe 263 to thusly be diffused. The diffused fragrance is then injected into the inner tub 140 together with the vapor flowing along the vapor discharge pipe 185 to come in contact with the clothes, thereby being permeated into tissues of the clothes. When it is desired to further supply fragrance, the button 316 is operated (pressed) and accordingly the controller 311 controls the solenoid 281 to further supply the fragrance solution.

Hereinafter, another embodiment of the present invention will be described with reference to FIGS. 10 and 11.

Figure 10:
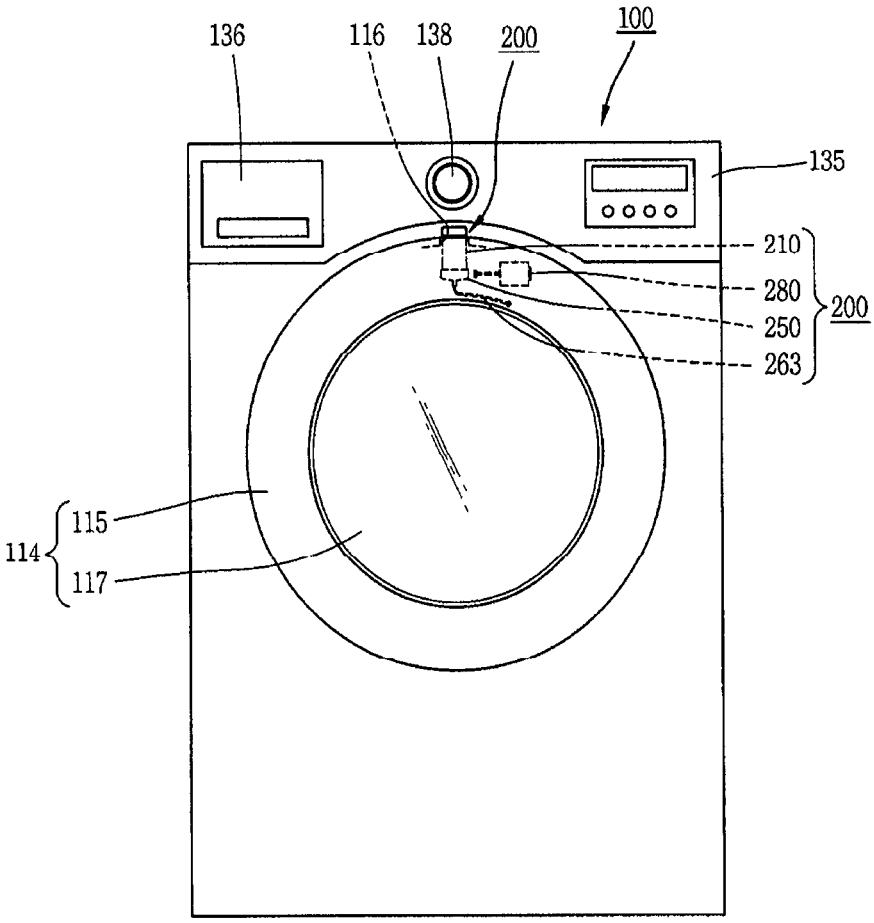
FIG. 10 is a front view of a washing/drying machine having a fragrance supply apparatus in accordance with another embodiment of the present invention.
Figure 11:
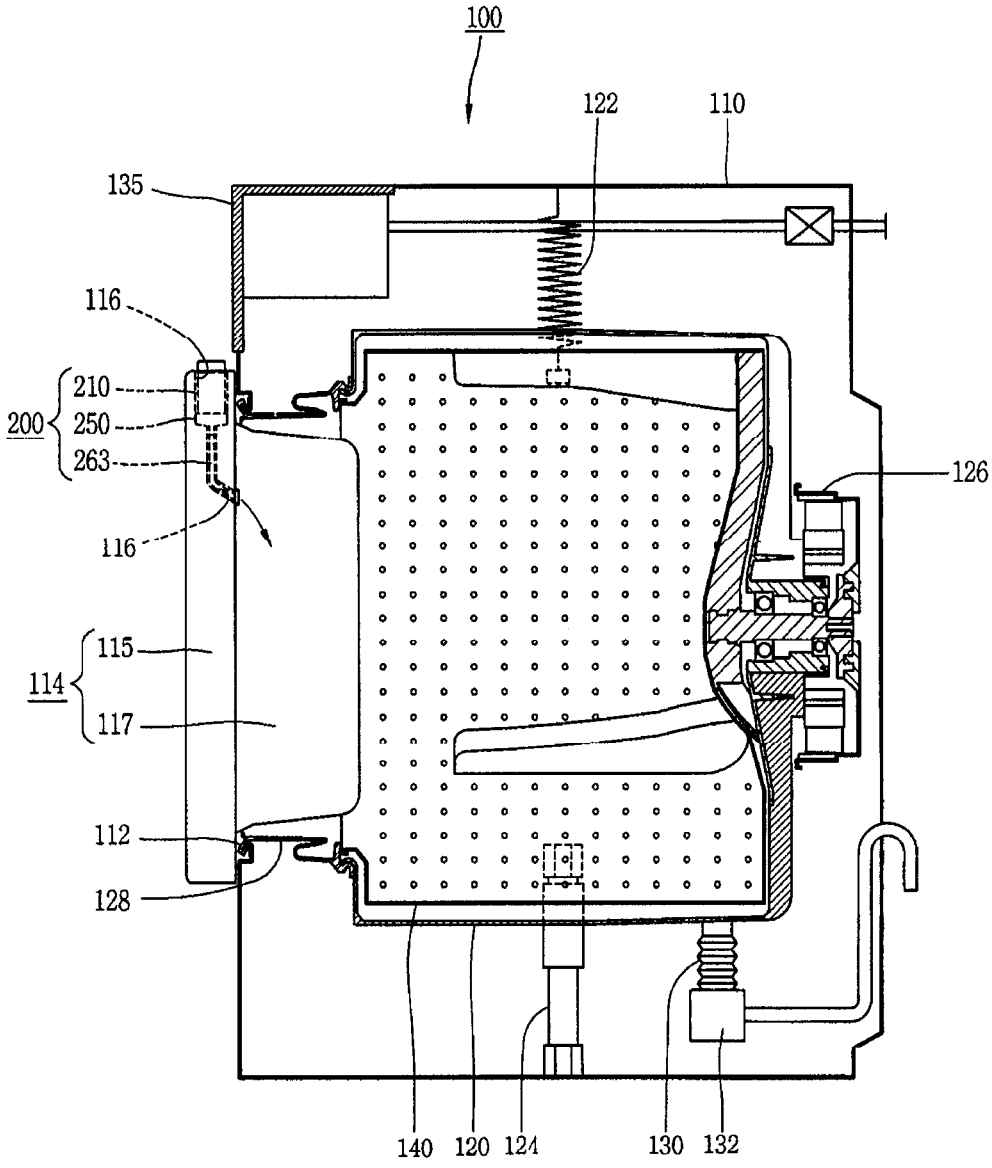
FIG. 11 is a lateral cross-sectional view of FIG. 10.

As shown in FIGS. 10 and 11, a washing/drying machine having a fragrance supply apparatus according to the present invention may include a washing/drying machine body 100 for collecting clothes to be treated, and a fragrance supply apparatus 200 configured such that a fragrance solution contained therein is uniformly diffused by a pressure difference so as to be supplied into the clothes collected in the washing/drying machine body 100.

The washing/drying machine body 100 may be implemented as a type of washing machine including a cabinet 110, an outer tub 120 installed in the cabinet 110, and an inner tub 140 rotatably installed in the outer tub 120. Opening and door 114 through which clothes are put into the inner tub 140 are disposed at the front surface of the cabinet 110. The fragrance supply apparatus 200 for supplying fragrance into the clothes inside the inner tub 140 is installed at the door 114.

The fragrance supply apparatus 200, as aforementioned, may include a fragrance solution container 210 for containing the fragrance solution therein, a fragrance solution outlet 261 through which the fragrance solution is effused, a dock 250 having an air inlet 271 formed at an upper side of the fragrance outlet 261, and an opening and closing unit 280 implemented as a solenoid 281 for opening and closing the air inlet 271.

The door 114 is provided with a frame portion 115 disposed outside the cabinet 110, and an insertion portion 117 inserted in the gasket 128. The frame portion 115 is generally formed in an annular shape, and the insertion portion 117 may be formed of a transparent member so as to observe the inside of the inner tub 140. The frame portion 115 includes an operation hole 116 through which the fragrance solution container 210 can be attached or detached from the outside. The fragrance solution outlet 261 of the dock 250 is connected to another end of the connection pipe 263 having one end extending to the surface of the insertion portion 117. Here, the fragrance supply apparatus 200 is configured to be disposed between the rear surface of the frame portion 115 and the front surface of the cabinet 110, and to allow the fragrance solution container 210 to be drawn out after the door 114 is open.

With such configuration, upon desiring to supply fragrance into the outer tub 120, power is applied to the solenoid 281 to open the air inlet 271. When the air inlet 271 is open, the fragrance solution is effused via the fragrance solution outlet 261 by a pressure difference between the fragrance solution outlet 261 and the air inlet 271. The effused fragrance solution then flows toward the surface of the insertion portion 117 via the connection pipe 263 to be diffused. The diffused fragrance is then spread into the inner tub 140 to be permeated into tissues of the clothes.

The present invention has been explained with reference to the embodiments which are merely exemplary. It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A washing/drying machine having a fragrance supply apparatus comprising:

a washing/drying machine body to collect clothes to be treated; and a fragrance supply apparatus to supply a fragrance solution contained therein into the clothes due to a pressure difference, the fragrance supply apparatus comprising:

a fragrance solution container to contain the fragrance solution therein;

a dock to which the fragrance solution container is connected, and having a fragrance solution outlet disposed below the fragrance solution container and an air inlet formed at an upper side of the fragrance solution outlet, wherein the air inlet is formed at a position where the pressure difference is generated to effuse the fragrance solution through the fragrance solution outlet;

an opening and closing unit to open and close the air inlet, and a controller to control the opening and closing unit, wherein the fragrance solution container comprises:

a container main body having a cylindrical shape for containing the fragrance solution therein, wherein the container main body is provided with an injection hole disposed at an upper end of the container main body for injecting the fragrance solution into the fragrance main body therethrough and a coupling unit formed a lower end of the container main body to be cut down in a radial direction of the container main body, a mount member coupled to the coupling portion of the container main body to be communicated with each other, wherein the mount member is provided with a dock coupling portion inwardly reduced in a radial direction and downwardly extended and having a discharge hole formed a central portion of the dock coupling portion, and a blocking member movably disposed in the mount member in a vertical direction to block the discharge hole of the mount member by its own weight when fragrance solution container is separated from the dock, wherein the dock comprises an opening operation portion to come in contact with the blocking member to upwardly move the blocking member, thus to open the discharge hole, the opening operation portion is upwardly protruded from an inner lower surface of the dock to be inserted into the discharge hole, wherein the pressure difference is generated while the air inlet is opened by the opening and closing unit so that the fragrance solution is dropped through the fragrance solution outlet, and wherein the supply of the fragrance solution is stopped while the air inlet is closed by the opening and closing unit.

2. The machine of claim 1, wherein the opening and closing unit comprises a solenoid for opening the air inlet when power is applied.

3. The machine of claim 2, wherein the washing/drying machine body comprises a tub in which the clothes are collected, an effusion side of the fragrance supply apparatus being connected the tub.

4. The machine of claim 3, wherein the washing/drying machine body further comprises:

a mode selector to select an operation mode including a fragrance supply mode for supplying fragrance into the clothes, wherein the controller controls the solenoid such that the fragrance is supplied when the fragrance supply mode is selected by the mode selector.

5. The machine of claim 4, wherein the fragrance supply mode supplies fragrance when performing at least one of the last rinsing and the last dehydrating during a washing process for the clothes.

6. The machine of claim 2, wherein the washing/drying machine body comprises:

a tub configured to collect the clothes therein; and a vapor generator configured to supply vapor to the tub, wherein the fragrance supply apparatus is connected to a vapor discharge pipe of the vapor generator.

7. The machine of claim 6, wherein the washing/drying machine body further comprises:

a mode selector configured to select an operation mode including a fragrance supply mode for supplying fragrance into the clothes; and a controller configured to control the solenoid such that the fragrance is supplied when the fragrance supply mode is selected by the mode selector.

8. The machine of claim 7, wherein the fragrance supply mode is configured to supply fragrance when performing at least one of the last rinsing and the last dehydrating during the washing process for the clothes.

9. The machine of claim 2, wherein the washing/drying machine body comprises:

a tub configured to collect the clothes therein; and a circulation duct through which air in the tub is blown out and circulated, wherein the fragrance supply apparatus is connected to the circulation duct.

10. The machine of claim 9, wherein the washing/drying machine body further comprises:

a mode selector configured to select an operation mode including a fragrance supply mode for supplying fragrance into the clothes; and a controller configured to control the solenoid such that the fragrance is supplied when the fragrance supply mode is selected by the mode selector.

11. The machine of claim 10, wherein the washing/drying machine body further comprises:

a fan configured to facilitate the circulation of air inside the circulation duct; and a heater configured to heat air in the circulation duct, wherein the fragrance supply mode is configured to supply fragrance when performing at least one of the last rinsing and the last dehydrating during a washing process for the clothes.

12. The machine of claim 11, wherein the fragrance supply mode is configured such that fragrance is supplied when the heater is turned off during a drying process for the clothes.

13. The machine of claim 1, wherein a fragrance solution flowing portion is formed at an upper surface of the blocking member to allow the fragrance solution to downwardly flow in spite of being contacted with the periphery of the lower opening of the container main body.

14. The machine of claim 1, wherein an operation hole through which the fragrance solution container is attached or detached from the outside is formed at the washing/drying machine body.

15. The machine of claim 1, wherein the container main body further comprises a cap coupled to the injection hole for tightly sealing the injection hole.

16. The machine of claim 1, wherein the blocking member comprises:

a body having a reduced size as compared to the discharge hole and disposed in the discharge hole to be movable up and down, and a flange portion formed at an upper end of the body and having an extended size as compared to the discharge hole, the flange portion contacted by an inner side of a lower surface of the mount member so as to block the effusion of the fragrance solution.

17. The machine of claim 16, wherein a sealing member is disposed at a lower surface of the flange portion to come in contact with the inner side of the lower surface of the mount member.

18. The machine of claim 13, wherein the fragrance solution flowing portion comprises a plurality of protrusions protruded from the block member and spaced apart from one another in a circumferential direction, and wherein the fragrance solution flows in each of spaces between the protrusions when each of the plurality of protrusions comes in contact with a lower surface of the container main body.

* * * * *